US011939119B2

(12) United States Patent
Dixon

(10) Patent No.: US 11,939,119 B2
(45) Date of Patent: Mar. 26, 2024

(54) TAMPER EVIDENT TUCK END CONTAINERS

(71) Applicant: WESTROCK MWV, LLC, Atlanta, GA (US)

(72) Inventor: Rodney D. Dixon, Burlington, NC (US)

(73) Assignee: WestRock MWV, LLC, Atlanta, GA (US)

( * ) Notice: Subject to any disclaimer, the term of this patent is extended or adjusted under 35 U.S.C. 154(b) by 0 days.

(21) Appl. No.: 17/827,941

(22) Filed: May 30, 2022

(65) Prior Publication Data

US 2023/0046700 A1 Feb. 16, 2023

Related U.S. Application Data

(63) Continuation of application No. 16/615,250, filed as application No. PCT/US2018/034642 on May 25, 2018, now Pat. No. 11,345,506.

(Continued)

(51) Int. Cl.
*B65D 5/10* (2006.01)
*B65D 5/54* (2006.01)

(52) U.S. Cl.
CPC ..... *B65D 5/10* (2013.01); *B65D 5/103* (2013.01); *B65D 5/541* (2013.01); *B65D 2401/15* (2020.05)

(58) Field of Classification Search
CPC .. B65D 5/10; B65D 5/103–106; B65D 5/541; B65D 5/0254; B65D 2401/15;

(Continued)

(56) References Cited

U.S. PATENT DOCUMENTS 3,543,995 A * 12/1970 Wilson ..... B65D 5/6664 229/149
3,595,466 A * 7/1971 Rosenburg, Jr. ..... B65D 5/5435 229/122

(Continued)

FOREIGN PATENT DOCUMENTS

EP 0397577 A1 * 11/1990
EP 0187463 * 10/2007

(Continued)

OTHER PUBLICATIONS

PCT Written Opinion and International Search Report dated Aug. 23, 2018, issued during the prosecution of PCT International Patent Application No. PCT/US2018/34642.

*Primary Examiner* — Nathan J Newhouse
*Assistant Examiner* — Phillip D Schmidt
(74) *Attorney, Agent, or Firm* — Brian J. Goldberg; Rohini K. Garg

(57) ABSTRACT

A blank for forming a tamper evident container includes a plurality of panels connected together at fold lines configured for extending at least partially around an interior space, including a first side panel, a top panel, a second side panel and a bottom panel. A bottom flap is foldably connected to an edge of the bottom panel on the first end of the blank. A top flap is foldably connected to an edge of the top panel on the first end of the blank. The bottom flap includes a major flap and a minor flap, the major flap connecting between the bottom panel and the minor flap. The top flap includes a catch point feature and wherein the minor flap includes a trap aperture configured to catch the catch point feature of the top flap when opening a container constructed from the blank to provide a tamper evident access feature.

20 Claims, 9 Drawing Sheets

Related U.S. Application Data

(60) Provisional application No. 62/512,872, filed on May 31, 2017.

(58) Field of Classification Search
CPC .... B65D 5/6608; B65D 5/6635; B65D 5/665; B65D 5/6655
USPC ..... 229/102, 141, 148–150, 152–153, 155, 229/159, 210, 221–223, 232, 240
See application file for complete search history.

(56) References Cited

U.S. PATENT DOCUMENTS

| | | | | |
|---|---|---|---|---|
| 4,746,052 | A | 5/1988 | Schmissrauter | |
| 5,207,374 | A * | 5/1993 | Lo Duca | B65D 5/0254 229/148 |
| 5,350,108 | A | 9/1994 | Friar et al. | |
| 5,443,202 | A * | 8/1995 | Jorgensen-Beck | B65D 5/6685 229/125.26 |
| 5,507,428 | A * | 4/1996 | Robinson, Jr. | B65D 5/0254 229/148 |
| 10,501,228 | B2 * | 12/2019 | Hsu | B65D 5/2057 |
| 10,875,677 | B2 * | 12/2020 | Davis | B65D 5/0254 |
| 11,377,252 | B2 * | 7/2022 | Borst, Sr. | B65D 5/42 |
| 2004/0195298 | A1 | 10/2004 | Schultz et al. | |
| 2017/0043929 | A1 | 2/2017 | Bressan | |
| 2017/0190501 | A1 * | 7/2017 | Hill | B65D 5/5014 |

FOREIGN PATENT DOCUMENTS

| | | | | |
|---|---|---|---|---|
| FR | 2693168 | A1 * | 1/1994 | B65D 5/0254 |
| FR | 2757481 | A3 * | 6/1998 | B65D 5/0254 |

* cited by examiner

TAMPER EVIDENT TUCK END CONTAINERS

CROSS-REFERENCE TO RELATED APPLICATIONS

This application is a continuation of U.S. patent application Ser. No. 16/615,250, filed on Nov. 20, 2019, which is a national stage application under 35 U.S.C. § 371 of international application no. PCT/US2018/034642, filed on May 25, 2018, which claims the benefit of priority under 35 U.S.C. § 119(e) to U.S. provisional application Ser. No. 62/512,872 filed on May 31, 2017, all of which are hereby incorporated by reference in their entirety.

BACKGROUND OF THE INVENTION

1. Field of the Invention

The present disclosure relates to packaging, and more particularly to tamper evident packaging.

2. Description of Related Art

A variety of packaging schemes are used to provide tamper evidence. Tamper evident features can either deter unauthorized tampering or clearly indicate whether unauthorized tampering has occurred, or both. This can allow a consumer or merchant to easily see whether the package has been opened or compromised, which can be beneficial for example in the case of packaged content that may be compromised if the packaging has been opened before purchase. Tamper evident features are desirable in applications such as over the counter medicines and prescription pharmaceuticals.

The conventional techniques have been considered satisfactory for their intended purpose. However, there is an ever present need for improved tamper evident packaging. This disclosure provides a solution for this problem.

SUMMARY OF THE INVENTION

A blank for forming a tamper evident container includes a plurality of panels connected together at fold lines configured for extending at least partially around an interior space, including a first side panel, a top panel, a second side panel and a bottom panel. A bottom flap is foldably connected to an edge of the bottom panel on the first end of the blank. A top flap is foldably connected to an edge of the top panel on the first end of the blank. The bottom flap includes a major flap and a minor flap, the major flap connecting between the bottom panel and the minor flap. The top flap includes a catch point feature and wherein the minor flap includes a trap aperture configured to catch the catch point feature of the top flap when opening a container constructed from the blank to provide a tamper evident access feature.

Each of the major and minor flaps can include a viewing aperture configured to allow viewing of the tamper evident access feature with the container constructed from the blank in a closed state prior to a first time opening. The viewing apertures can be the same size and shape and can be aligned with one another for viewing the tamper evident access feature through the full size and shape of the viewing apertures.

The tamper evident access feature can be partially surrounded by a cut line. The tamper evident access feature can be partially surrounded by a void in the top panel and/or the top end flap. The tamper evident access feature can be connected to a main portion of the top end flap by only a pair of frangible bridges configured to break when the catch point feature is trapped by the trap aperture.

The top panel can include a void area defining a lunate portion configured to facilitate opening a container formed from the blank. The major panel can include a tab configured to form a leading edge for closure of a container formed from the blank.

A second bottom flap can be foldably connected to an edge of the bottom panel on the second end of the blank. A second top flap can be foldably connected to an edge of the top panel on the second end of the blank, wherein the second bottom flap includes a major flap and a minor flap and wherein the second top flap includes a catch point feature as described above with respect to the first end of the blank.

A tamper evident container includes a plurality of panels connected together at fold lines and extending at least partially around an interior space, and flaps as described above. The major and minor flaps are adhered together with adhesive.

A method of assembling a tamper evident container includes forming a plurality of panels of a blank as described above to wrap at least partially around an interior space. The method also includes adhering the major and minor flaps together to form a container ready to receive product. Adhering the major and minor flaps together can include adhering the major and minor flaps together with the viewing apertures aligned to allow viewing of the tamper evident access feature therethrough with the container fully closed before a first opening of the container.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
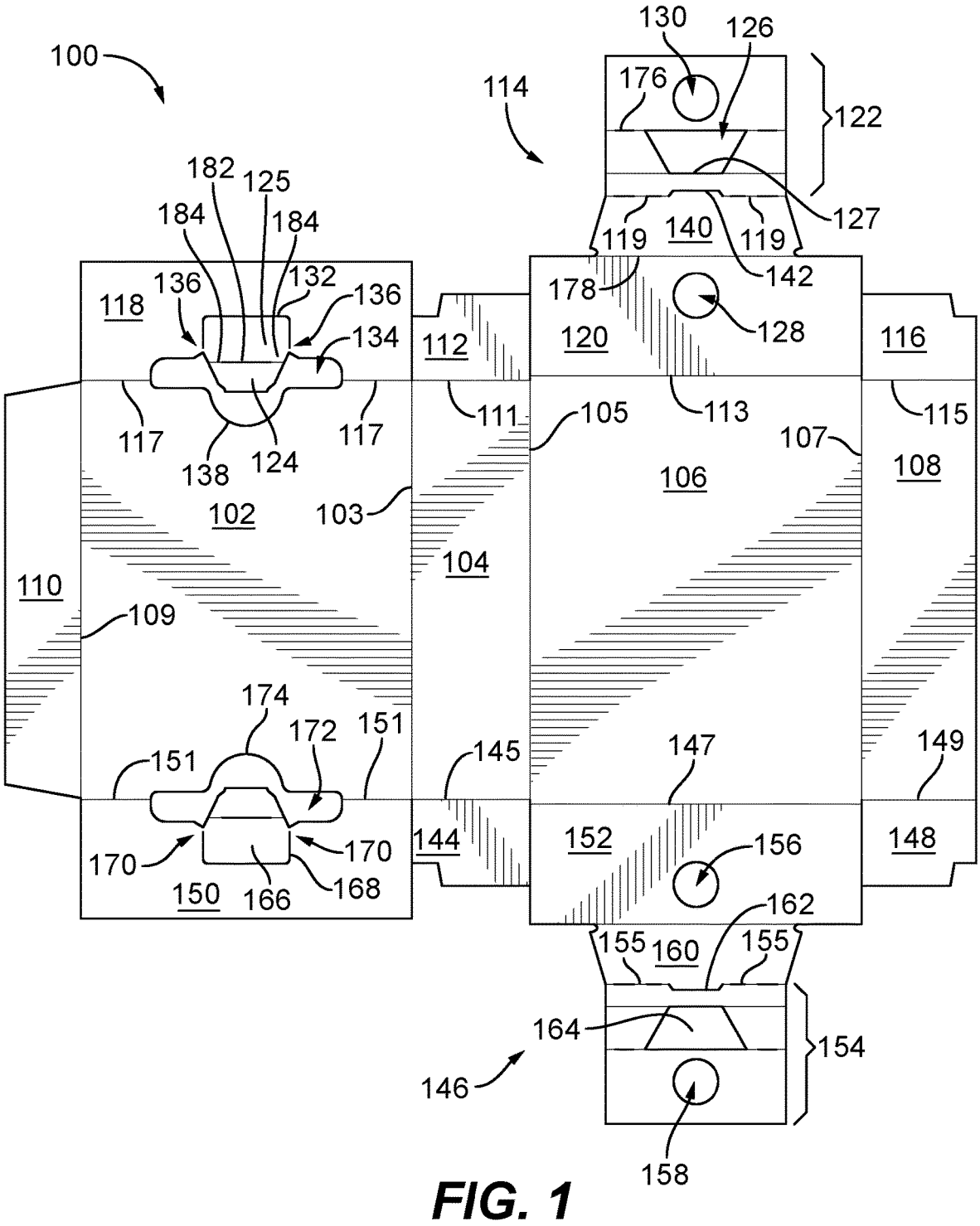
FIG. 1 is a plan view of an exemplary embodiment of a blank constructed in accordance with the present disclosure, showing the panels and flaps prior to folding.

Reference will now be made to the drawings wherein like reference numerals identify similar structural features or aspects of the subject disclosure. For purposes of explanation and illustration, and not limitation, a partial view of an exemplary embodiment of a blank for a container in accordance with the disclosure is shown in FIG. 1 and is designated generally by reference character 100. Other embodiments of blanks or containers in accordance with the disclosure, or aspects thereof, are provided in FIGS. 2-9, as will be described. The systems and methods described herein can be used to provide tamper evident packaging, e.g., for pharmaceutical products and the like.

The blank 100 for forming a tamper evident container 101, which is shown in FIGS. 2-9, includes a plurality of panels connected together at fold lines configured for extending at least partially around an interior space, i.e., the interior space of the container 101 shown in FIGS. 2-9. The plurality of panels includes a top panel 102 connected along a fold line 103 to a first side panel 104. The first side panel 104 connects along a fold line 105 to a bottom panel 106. A second side panel 108 connects the bottom panel 106 along a fold line 107. An adhesive flap 110 is connected to the top panel 102 along a fold line 109. Blank 100 can be constructed of any suitable paper board material and/or tear resistant material.

A first side flap 112 is foldably connected to a fold line 111 to an edge of the first side panel 104 on a first end, i.e., the top end as oriented in FIG. 1, of the blank 100. A bottom flap 114 is foldably connected along fold line 113 to an edge of the bottom panel on the first end of the blank 100. A second side flap 116 is foldably connected along fold line 115 to an edge of the second side panel 108 on the first end of the blank 100. A top flap 118 is foldably connected along fold line 117 to an edge of the top panel 102 on the first end of the blank 100. The bottom flap 114 includes a major flap 120 and a minor flap 122. The major flap 120 connects between the bottom panel 106 and the minor flap 122. The top flap 118 includes a catch point feature 124 and an anchor panel 125 for the catch point feature. The minor flap 122 includes a trap aperture 126 configured to catch the catch point feature 124 of the top flap 118 when opening a container 101 constructed from the blank 100 to provide a tamper evident access feature, as described below with respect to FIGS. 6-8.

Each of the major and minor flaps 120 and 122 includes a viewing aperture 128 and 130, respectively, configured to allow viewing of the anchor panel 125 of the catch point feature 124 with the container 101 constructed from the blank 100 in a closed state prior to the first time opening. The viewing apertures 128 and 130 are the same size and shape, i.e., circular or other suitable shape, and are aligned with one another for viewing the anchor panel 125 through the full size and shape of the viewing apertures 128 and 130. Viewing apertures are therefore equidistant from fold line 119 connecting the major flap 120 to the minor flap 122.

The catch point feature 124 and anchor panel 125 are partially surrounded by a cut line 132. The catch point feature 124 and anchor panel 125 also partially surrounded by a void 134 in the top panel 102 and/or the top end flap 118. The catch point feature 124 and anchor panel 125 are connected to the main portion of the top end flap 118 only by a pair of frangible bridges 136 configured to break when the catch point feature 124 is trapped by the trap aperture 126 as will be shown and described below with reference to FIGS. 6-8.

An area of the void 134 in top panel 102 defines a lunate portion 138 configured to facilitate opening a container 101 formed from the blank 100. A tuck portion 140 of the major panel includes a tab 142 which is formed by a cut in between the two portions of fold line 119 and is configured to form a leading edge for closure of a container 101 formed from the blank 100.

The flaps of the first end, i.e. the top as oriented in FIG. 1, of blank 100 are described above. The second end, i.e., the bottom as oriented in FIG. 1, of blank 100 has a similar set of flaps, wherein the fold lines and features are essentially mirrored. A side flap 144 is foldably connected along a fold line 145 to an edge of the first side panel 104. A second bottom flap 146 is foldably connected along a fold line 147 to an edge of the bottom panel 106. A side flap 148 is foldably connected along a fold line 149 to an edge of the second side panel 108. A second top flap 150 is foldably connected along a fold line 151 to an edge of the top panel 102. The second bottom flap 146 includes a major flap 152 and a minor flap 154, as described above with respect to the first end of the blank 100, including viewing apertures 154 and 158, fold line 155, tuck portion 160, tab 162, and trap aperture 164 as described above. The second top flap 150 includes a catch point feature 166, including a cut line 168, bridges 170, void 172, and lunate portion 174 as described above with respect to the first end of the blank 100.

Figure 2:
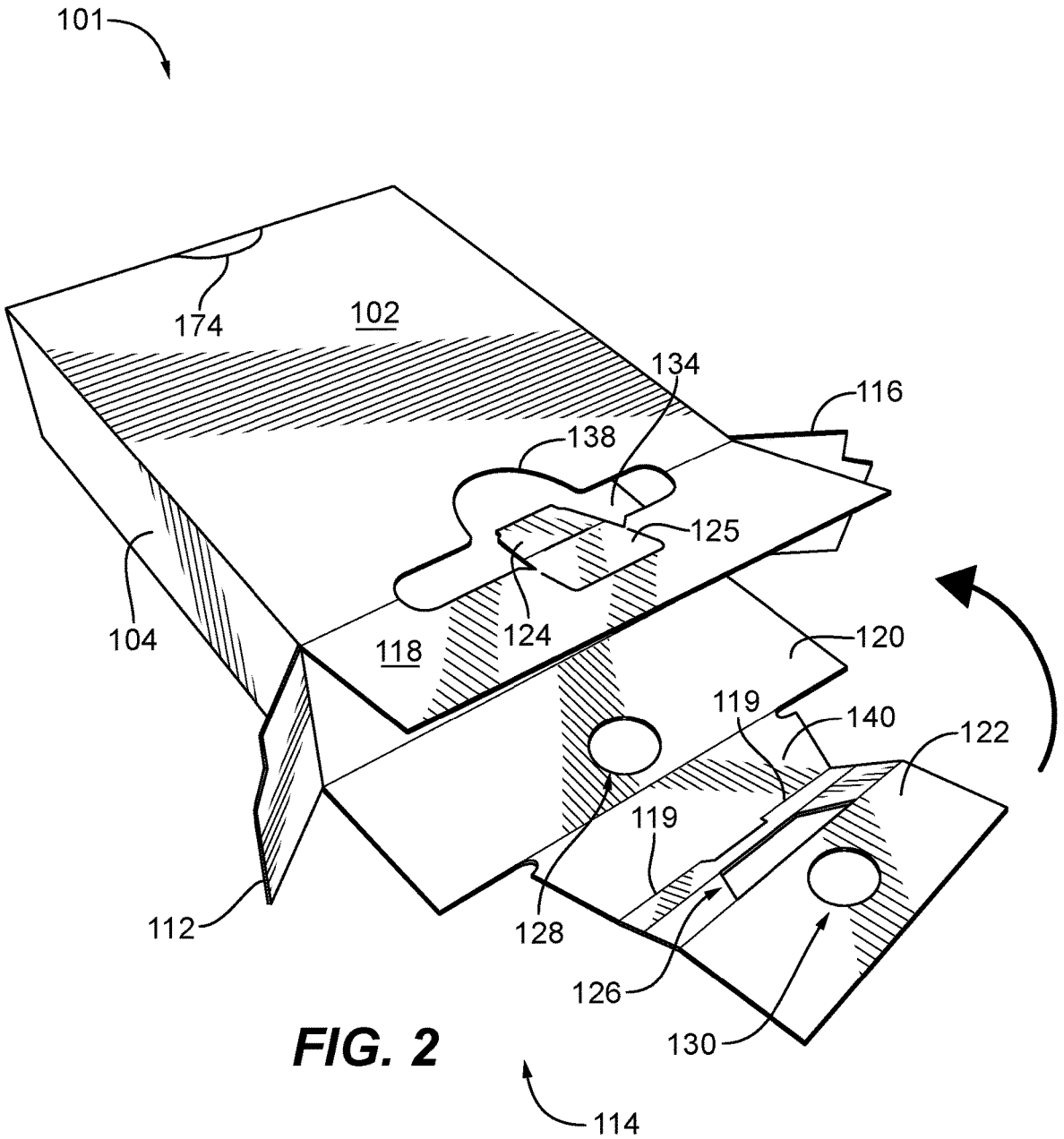
FIG. 2 is a perspective view of the blank of FIG. 1, showing the blank in the process of being formed into a container.

With reference now to FIG. 2, a tamper evident container 101 is shown constructed from the blank 100 of FIG. 1. In FIG. 2, the adhesion flap 110 is adhered to the inside of the side flap 108, and fold lines 103, 105, 107, and 109 are folded to wrap side panels 108 and 104 and top and bottom panels 102 and 106 around the interior space, which will eventually be for receiving product, as shown in FIG. 2. In FIG. 2, the flaps 144, 146, 148, and 150 are adhered, folded, and/or tucked to form a closure on the second end of the container 102, which closure is formed in the same manner as the closure on the first end of container 102. The closure of the first end of the container 102, i.e. the top end as oriented in FIG. 1 or the foreground end as oriented in FIG. 2, will now be described. The major and minor flaps 120 and 122 folded together along fold line 119 as indicated by the large arrow in FIG. 2 and are adhered together with adhesive with the viewing apertures 128 and 130 aligned together for viewing therethrough.

Figure 3:
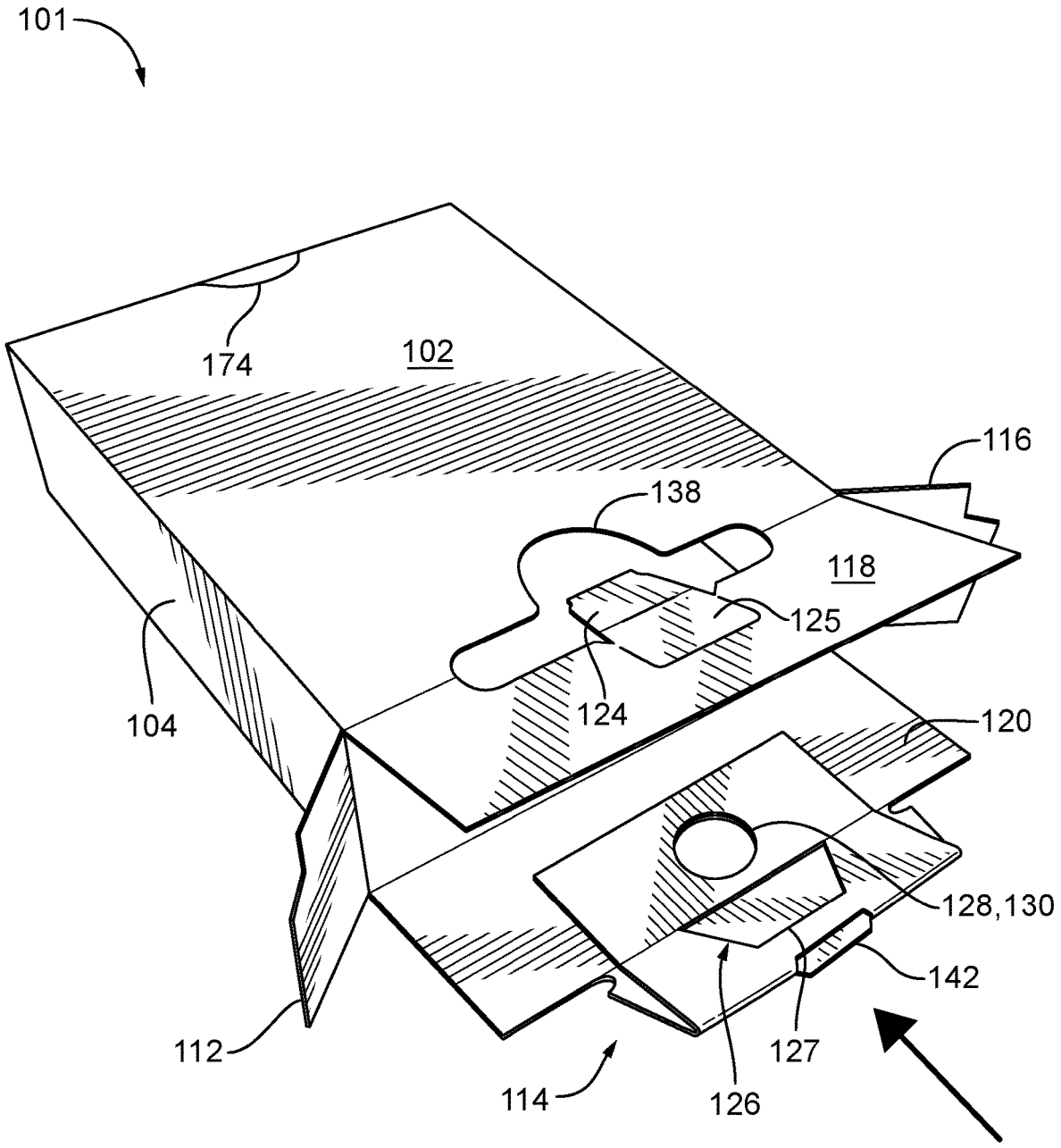
FIG. 3 is a perspective view of the container of FIG. 2, showing a stage in the closure of the container ready to receive contents inside.
Figure 4:
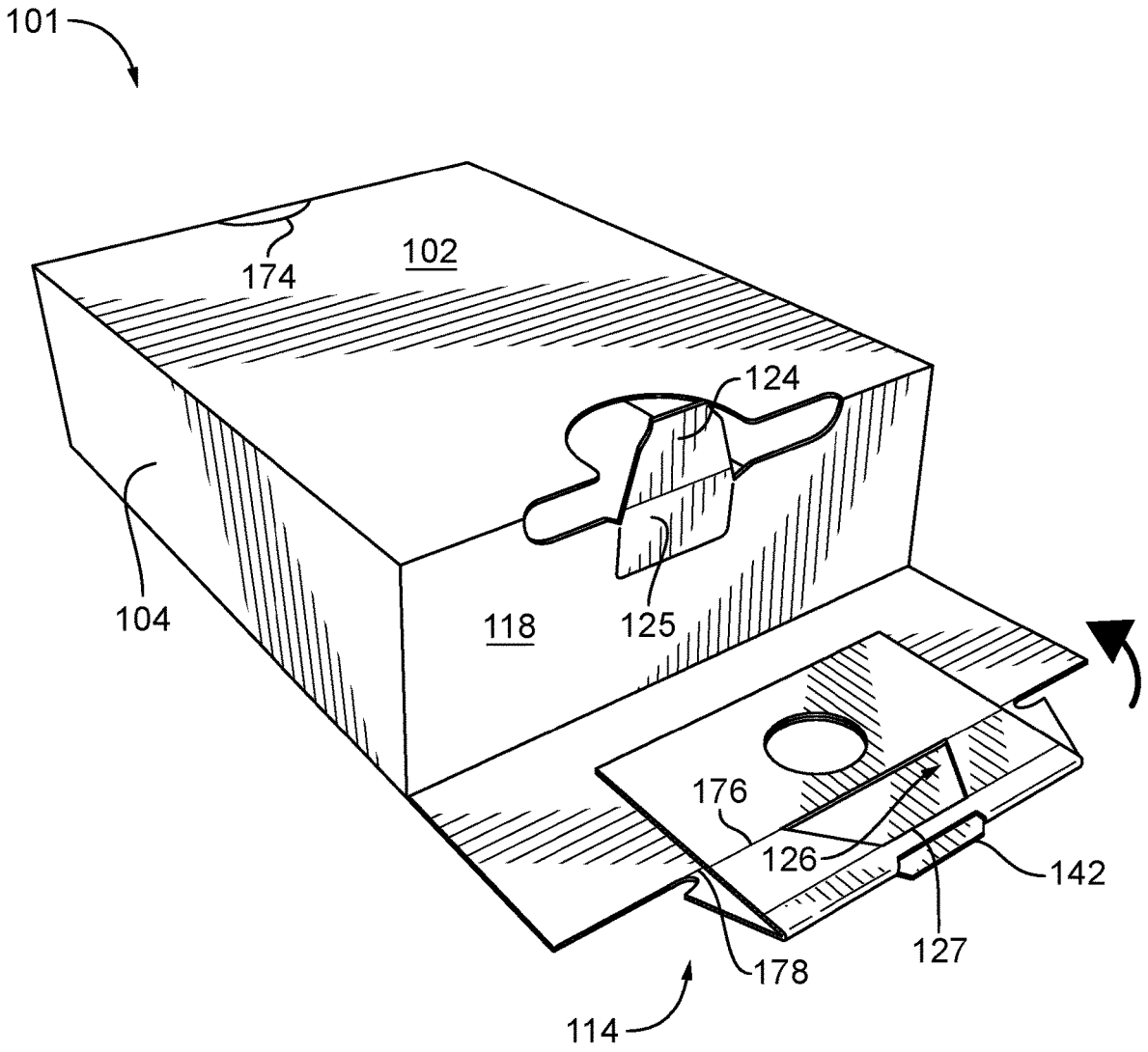
FIG. 4 is a perspective view of the container of FIG. 2, showing the container prior to closing the tuck end.
Figure 5:
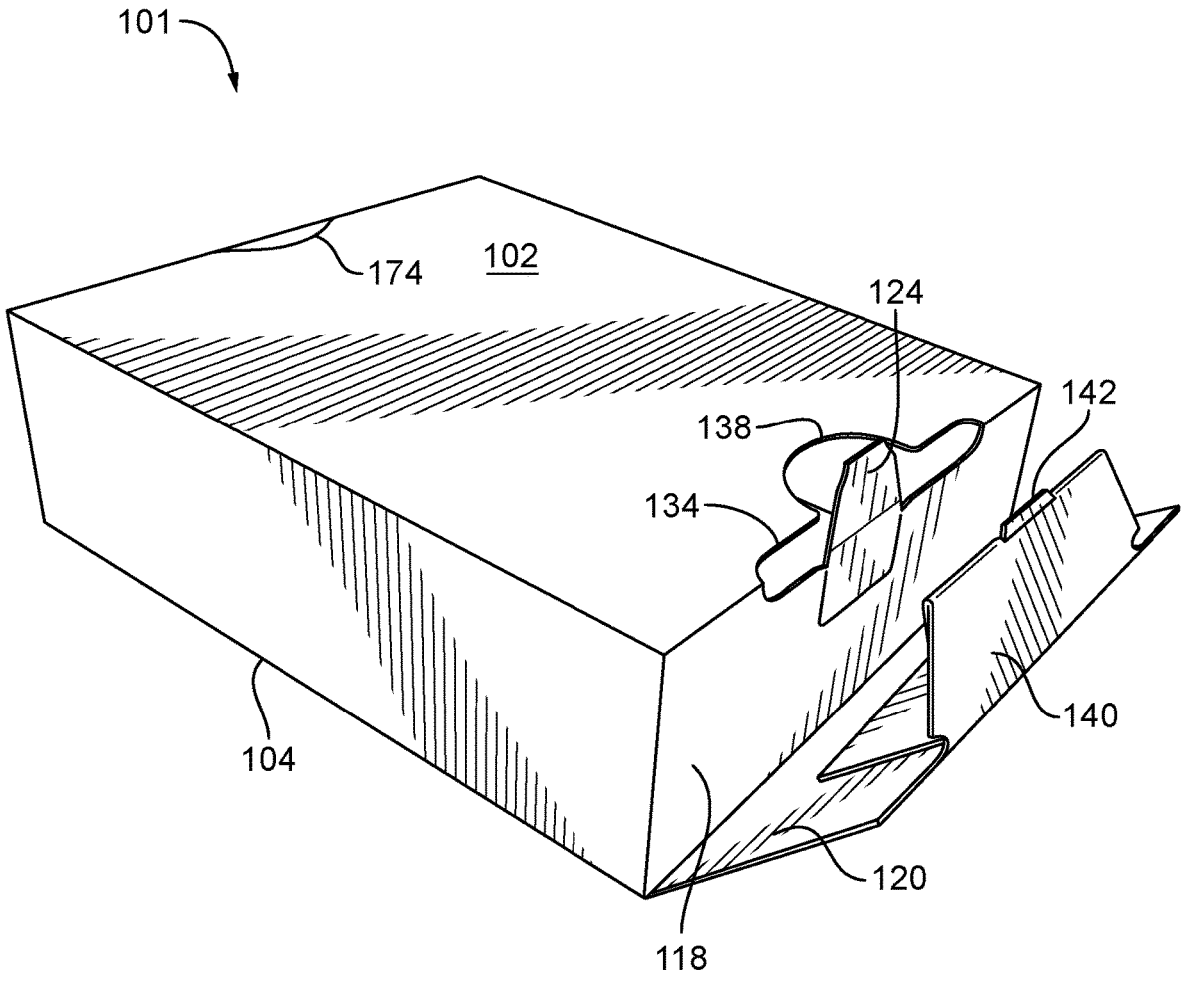
FIG. 5 is a perspective view of the container of FIG. 2, showing the tuck end being closed.
Figure 6:
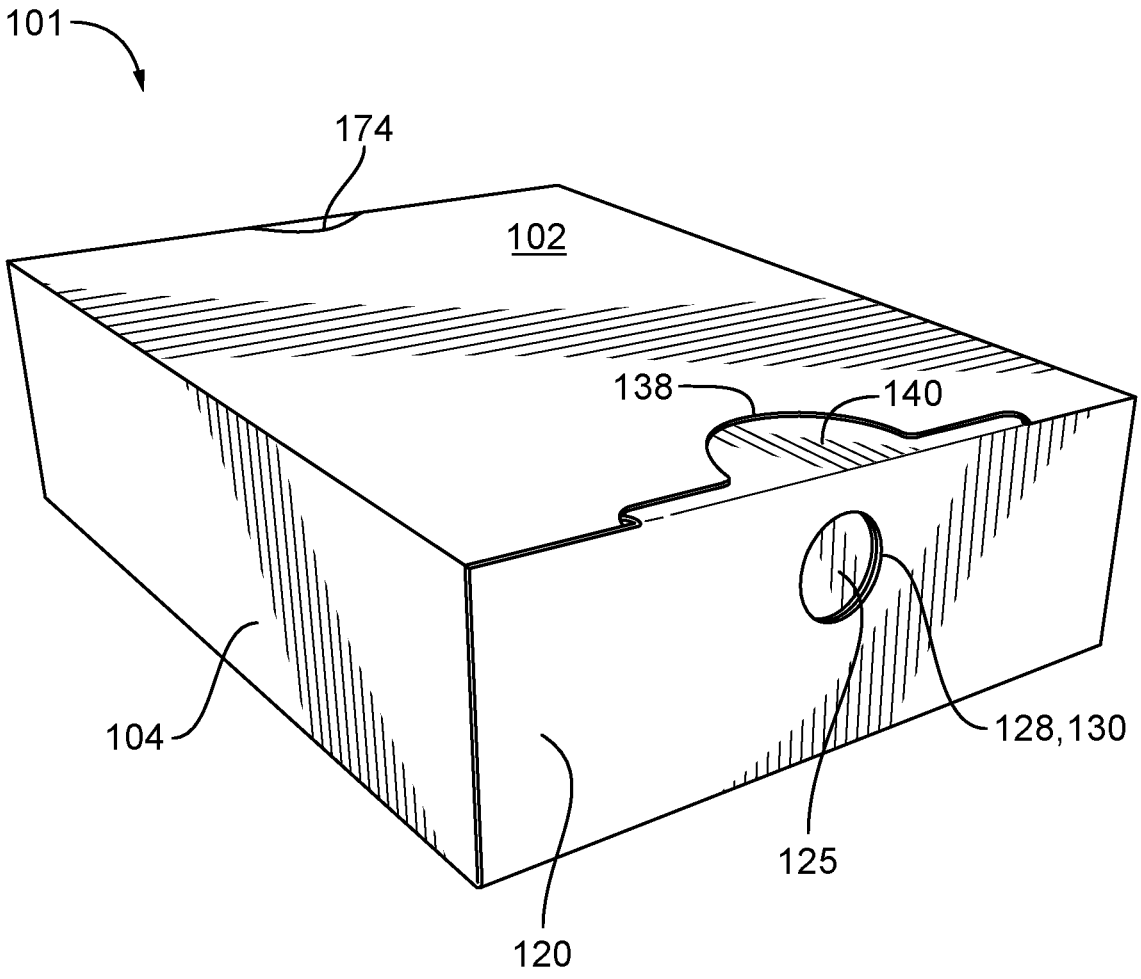
FIG. 6 is a perspective view of the container of FIG. 2, showing the container completely formed with both ends closed.

With reference now to FIG. 3, the major and minor flaps 120 and 122 of bottom flap 114 are shown adhered together. The blank 100 be prepared at a first facility, and can be shipped to a second facility to be formed into a container 101 as shown in FIG. 3, filled with a product, and then closed as shown in FIGS. 4-6. In FIG. 4, the top flap 118 is folded and optionally adhered over the side flaps 112 and 116 (shown in FIG. 3 before they are folded inward as in FIG. 4). The major and minor flaps 120 and 122 can be folded along fold lines 176 and 178 (also shown in FIG. 1) as indicated in FIG. 4 by the curved arrow to prepare tuck portion 140 to be tucked into void 134. Trap aperture 126 is bounded on one side by trap edge 127.

With reference now to FIG. 5, with the tuck portion 140 prepared as described above, the tuck portion 140 can be tucked into void 134. Since catch point feature 124 is standing upright as oriented in FIG. 5, it will end up becoming trapped inside trap aperture 126, which is shown in FIG. 4, when the tuck portion 140 is completely tucked into the closed position shown in FIG. 6. Tab 142 forms a leading edge that facilitates the tucking process.

Both ends of container 101 can ultimately be tucked and closed to secure the product inside. To initiate opening container 101 to access the product inside, a consumer can grip the tuck portion 140 exposed inside lunate portion 138 of void 134, e.g. using a thumb, and then the consumer can use this grip to initially untuck the tuck portion 140.

Figure 7:
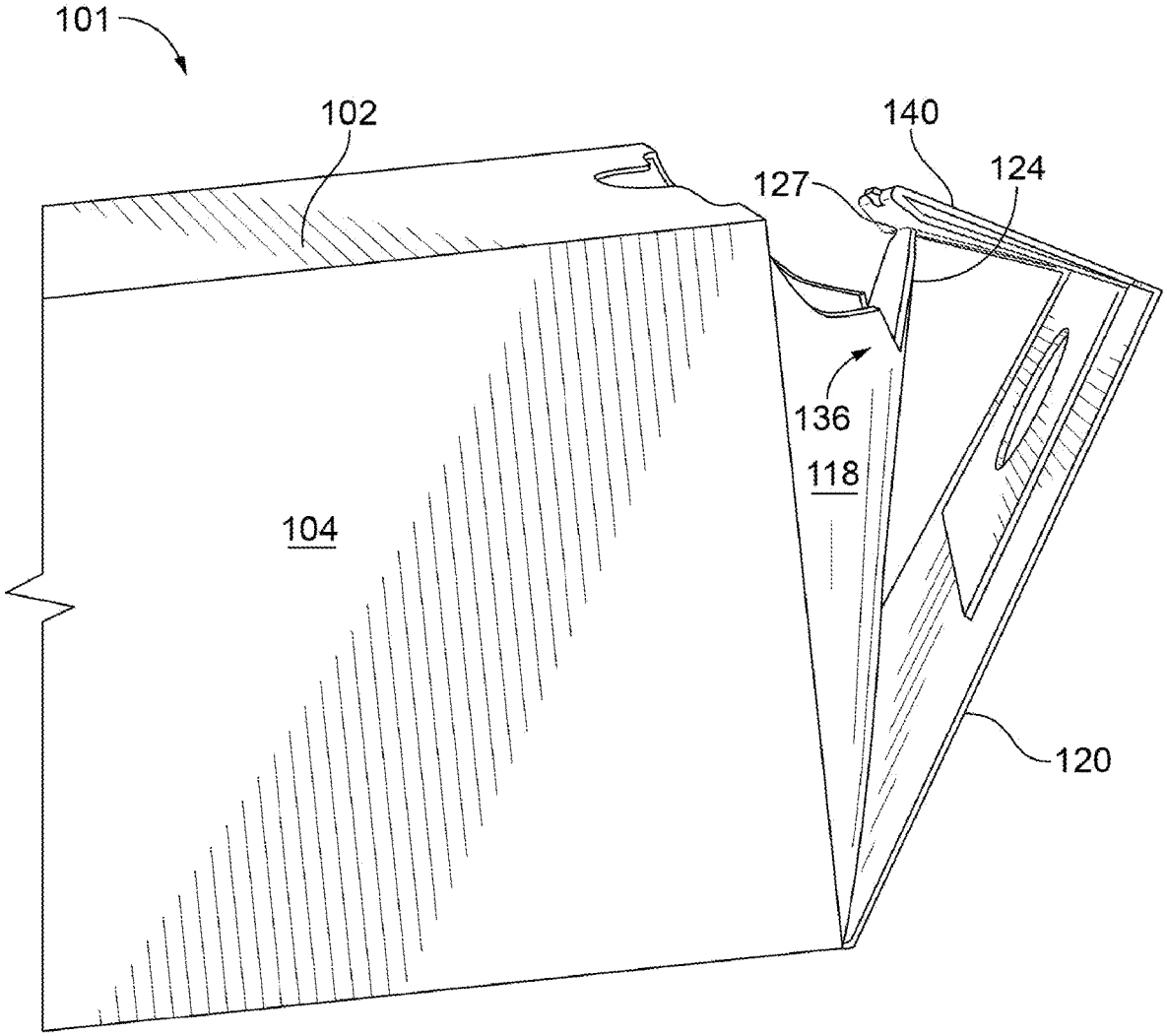
FIG. 7 is a perspective view of the container of FIG. 2, showing the catch point feature catching during opening of the tuck end.
Figure 8:
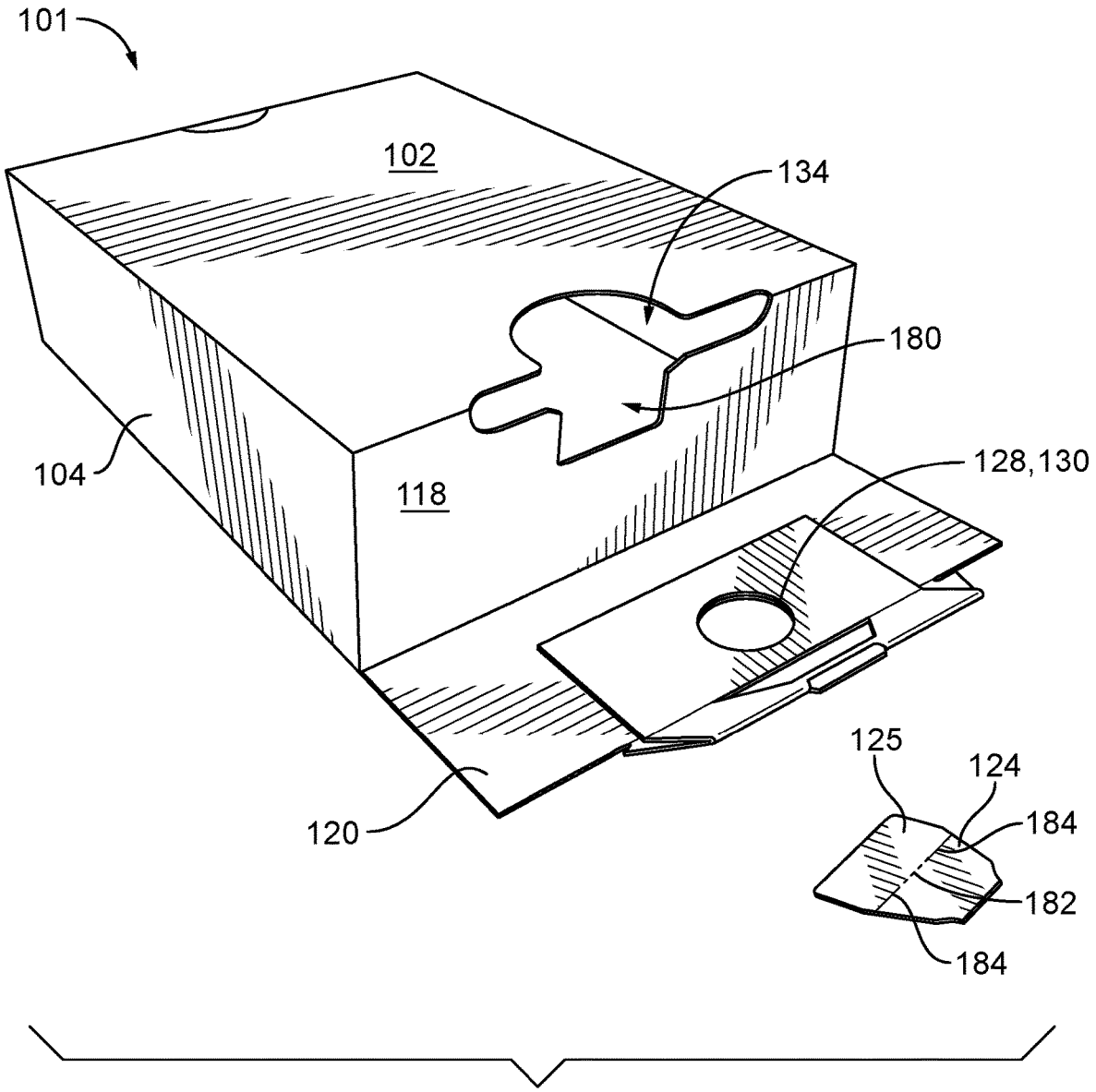
FIG. 8 is a perspective view of the container of FIG. 2, showing the catch point feature removed for tamper evidence due to catching during opening of the tuck end.

With reference now to FIG. 7, as the consumer untucks the tuck portion 140, the top tip of catch point feature 124 (as oriented in FIG. 7) catches on trap edge 127, facilitated by the triangular cross-section of minor flap 122 including tuck portion 140 that is visible in FIG. 7. As the consumer continues to pull tuck end 140 and major flap 120 open, one or both of the bridges 136 that hold catch point feature 124 and anchor panel 125 to top flap 118 break. The consumer can then remove catch point feature 124 and anchor panel 122 completely from the top flap 118 and discard as indicated in FIG. 8, where the catch point feature is shown separated from the rest of the container 101. A new portion 180 of the void 134 is left after removal of catch point feature 124 and anchor panel 125. Catch point feature 124 connects to anchor panel 125 along a cut 182 between two portions of a score line 184 that route pressure off catch point feature 124 to facilitate removal of catch point feature 124 and anchor panel from top flap 118. When the end of the container 101 is tucked closed, the catch point feature can angle inward and downward about score line 184 at an angle of about 80% from the angle of the top panel 102.

Figure 9:
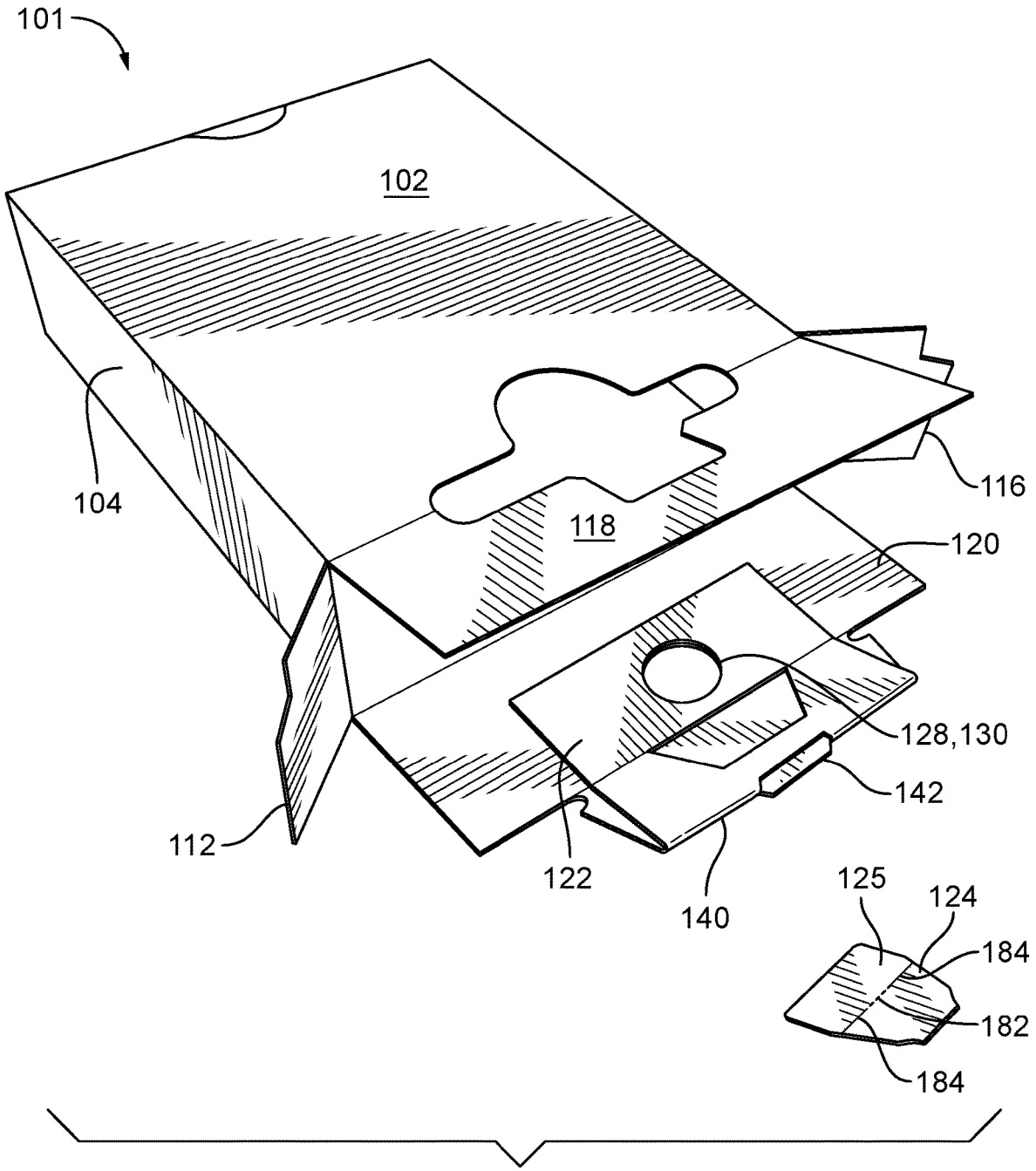
FIG. 9 is a perspective view of the container of FIG. 2, showing the container fully opened.

At this point, top flap 118 can be lifted upward and fully opened as shown in FIG. 9, whereupon product can be accessed from the interior space. The flaps of the first end of the container 101 can be reclosed by folding inward much as described above, followed by re-tucking in tuck end 140. Thereafter, the tuck end 140 can be tucked in or out as needed to reopen and reclose the container 101. Those skilled in the art will readily appreciate that the opposite end of container 101 can be opened, reclosed, and reopened in the same manner described herein with reference to the end with major and minor flaps 120 and 122.

The catch point feature 124 and anchor panel 125 together form a tamper evident access feature that can operate to tell a consumer or seller whether the product has been accessed and/or compromised before its first intended use. For example, if after initial packing, if there has been no tampering and container 101 has never been opened, then the anchor panel 125 will be visible through the viewing apertures 128 and 130 as shown in FIG. 6. If the first opening has already occurred, or the container 101 has been tampered with before the consumer's first use of the product, the anchor panel 125 will appear compromised through the viewing apertures 128 and 130 and/or will be missing completely in which case the interior space of the container 101 will be visible through viewing apertures 128 and 130 as well as portion 180 of the void 134. The anchor panel 125 can be printed in a different color and/or have indicia printed thereon, such as the word "SAFE" or the like to assist in the determination described above.

The methods and systems of the present disclosure, as described above and shown in the drawings, provide for tamper evident packaging with superior properties including ease of use and manufacture. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A blank for forming a tamper evident container comprising:

a plurality of panels connected together at fold lines configured for extending at least partially around an interior space, including a top panel, and a bottom panel;

a bottom flap foldably connected to an edge of the bottom panel on a first end of the blank; and a top flap foldably connected to an edge of the top panel on the first end of the blank, wherein the bottom flap includes a major flap a minor flap and a tuck portion between the major flap and the minor flap, the major flap connecting between the bottom panel and the minor flap, wherein the top flap includes a catch point feature and wherein the minor flap includes a trap aperture configured to catch the catch point feature of the top flap when opening a container constructed from the blank to provide a tamper evident access feature, wherein the tuck portion includes a tab configured to form a leading edge for closure of the container.

2. The blank as recited in claim 1, wherein the catch point feature is partially surrounded by a cut line.

3. The blank as recited in claim 1, wherein the catch point feature is partially surrounded by a void in the top panel and/or the top end flap.

4. The blank of claim 3, wherein the tuck portion is configured to be tucked into the void when closing the container.

5. The blank as recited in claim 1, wherein the catch point feature is connected to a main portion of the top end flap only by a pair of frangible bridges configured to break when the catch point feature is trapped by the trap aperture.

6. The blank as recited in claim 1, wherein the top panel includes a void area defining a lunate portion configured to facilitate opening a container formed from the blank, wherein the tuck portion is visible through the lunate portion.

7. The blank of claim 1 wherein the top flap comprises an anchor panel for the catch point feature.

8. The blank as recited in claim 7, wherein each of the major and minor flaps includes a viewing aperture configured to allow viewing of the anchor panel of the catch point feature with the container constructed from the blank in a closed state prior to a first time opening.

9. The blank as recited in claim 8, wherein the viewing apertures are the same size and shape and are aligned with one another for viewing of the anchor panel of the catch point feature through the full size and shape of the viewing apertures.

10. The blank as recited in claim 7, further comprising:

a second bottom flap foldably connected to an edge of the bottom panel on the second end of the blank; and a second top flap foldably connected to an edge of the top panel on the second end of the blank, wherein the second bottom flap includes a major flap and a minor flap, the major flap connecting between the bottom panel and the minor flap, wherein the top flap includes a catch point feature and wherein the minor flap includes a trap aperture configured to catch the catch point feature of the second top flap when opening a container constructed from the blank to provide a tamper evident access feature.

11. The blank as recited in claim 10, wherein each of the major and minor flaps of the second bottom flap includes a viewing aperture configured to allow viewing of the anchor panel of the catch point feature with the container constructed from the blank in a closed state prior to a first time opening.

12. A tamper evident container comprising:

a plurality of panels connected together at fold lines and extending at least partially around an interior space, including a top panel, and a bottom panel;

a bottom flap foldably connected to an edge of the bottom panel on first end of the blank; and a top flap foldably connected to an edge of the top panel on the first end of the blank, wherein the bottom flap includes a major flap, a minor flap and a tuck portion between the major flap and the minor flap, the major flap connecting between the bottom panel and the minor flap, wherein the top flap includes a catch point feature and wherein the minor flap includes a trap aperture configured to catch the catch point feature of the top flap when opening the container to provide a tamper evident access feature, wherein the tuck portion includes a tab that form a leading edge for closure of the container.

13. The container as recited in claim 12, wherein each of the major and minor flaps includes a viewing aperture configured to allow viewing of the tamper evident access feature with the container in a closed state prior to a first time opening, and wherein the viewing apertures are the same size and shape and are aligned with one another for viewing the tamper evident access feature through the full size and shape of the viewing apertures.

14. The container as recited in claim 12, wherein the tamper evident access feature is partially surrounded by a cut line, wherein the tamper evident access feature is partially surrounded by a void in the top panel and/or the top end flap, and wherein the tamper evident access feature is connected to a main portion of the top end flap only by a pair of frangible bridges configured to break when the catch point feature is trapped by the trap aperture.

15. The container of 14, wherein the tuck portion is configured to be tucked into the void when closing the container.

16. The container as recited in claim 12, wherein the top panel includes a void area defining a lunate portion configured to facilitate opening a container formed from the blank, wherein the tuck portion is visible through the lunate portion.

17. The container as recited in claim 12, wherein the major and minor flaps are adhered together with adhesive.

18. The container as recited in claim 12, further comprising:

a second bottom flap foldably connected to an edge of the bottom panel on the second end of the blank; and a second top flap foldably connected to an edge of the top panel on the second end of the blank, wherein the second bottom flap includes a major flap and a minor flap, the major flap connecting between the bottom panel and the minor flap, wherein the second top flap includes a catch point feature and wherein the minor flap includes a trap aperture configured to catch the catch point feature of the second top flap when opening the container to provide a tamper evident access feature.

19. The container as recited in claim 18, wherein each of the major and minor flaps of the second bottom flap includes a viewing aperture configured to allow viewing of the tamper evident access feature of the second top flap with the container in a closed state prior to a first time opening, and wherein the viewing apertures are the same size and shape and are aligned with one another for viewing the tamper evident access feature through the full size and shape of the viewing apertures, wherein the tamper evident access feature of the second top flap is partially surrounded by a cut line, wherein the tamper evident access feature of the second top flap is partially surrounded by a void in the top panel and/or the second top end flap, and wherein the tamper evident access feature of the second top flap is connected to a main portion of the second top end flap only by a pair of frangible bridges configured to break when the catch point feature is trapped by the trap aperture of the second bottom flap.

20. The container of claim 12 wherein the top flap comprises an anchor panel for the catch point feature.

* * * * *